United States Patent [19]

Sullivan

[11] Patent Number: 4,872,633

[45] Date of Patent: Oct. 10, 1989

[54] AIR RATCHET HOLDER

[76] Inventor: Michael C. Sullivan, 7772 Darwin Ave., Midway City, Calif. 92655

[21] Appl. No.: 177,330

[22] Filed: Apr. 4, 1988

[51] Int. Cl.[4] ..... B42F 13/00

[52] U.S. Cl. ..... 248/340; 248/227; 248/304; 248/311.2

[58] Field of Search ..... 248/340, 339, 341, 317, 248/316.7, 314, 309.1, 79, 113, 215, 227, 231.7, 231.8, 304, 309.4, 205.5, 311.2, 51, 52; 81/57.4; 211/113, 70.6

[56] References Cited

U.S. PATENT DOCUMENTS

| | | | |
|---|---|---|---|
| 1,127,987 | 2/1915 | Green | 248/317 |
| 2,527,435 | 10/1950 | Little et al. | 248/316.7 |
| 2,700,100 | 1/1955 | Wissinger | 248/311.2 X |
| 2,788,438 | 4/1957 | Lieuwen | 248/339 X |
| 3,559,934 | 2/1971 | Jensen | 248/316.7 X |
| 4,015,810 | 4/1977 | Williams | 248/311.2 |
| 4,136,848 | 1/1979 | McCollum | 248/316.7 |
| 4,605,190 | 8/1986 | Kamp | 248/316.7 |
| 4,676,465 | 6/1987 | Myotte | 248/316.7 X |

*Primary Examiner*—Ramon O. Ramirez

*Attorney, Agent, or Firm*—Roy A. Ekstrand

[57] ABSTRACT

An air ratchet holder for use in supporting an air ratchet tool includes a semicylindrical cradle portion having an end cap and a hook secured thereto. A C-shaped clasp means are secured within the interior of the semicylindrical cradle and are adapted to grasp the neck kportion of an air ratchet tool and secure it within the cradle interior. A hook is secured to the upper portion of the cradle to permit attachment to the under portion of a vehicle supported upon a hoist or the like. In an alternate embodiment, a magnetic clasp is used in place of the hook to provide for magnetic attachment of the air ratchet holder to a convenient metal member of the vehicle. An aperture in the cradle portion permits the air ratchet to be received within the holder in a reverse position.

16 Claims, 2 Drawing Sheets

AIR RATCHET HOLDER

FIELD OF THE INVENTION

This invention relates generally to vehicle repair systems and particularly to tool holders for use in combination with air powered tools.

BACKGROUND OF THE INVENTION

In the majority of operations of repair and maintenance performed upon motor vehicles such as automobiles or trucks or the like, a facilty is utilized which includes a convenient ramp or hoist mechanism which raises the vehicle above the floor a substantial distance to permit the mechanic or other repair or maintenance personnel to operate beneath the vehicle and gain ready access to the majority of operative portions of the vehicle. While such repair hoists and the like provide a relatively convenient operating area for the repair and maintenance personnel, certain problems arise in the use of the wide variety of tools employed in the maintenance and repair services. In essence, the repair personnel must choose between maintaining the tools close at hand or face the difficulties of constantly moving to and from the tool storage cabinet as different tools are employed. For the majority of small hand tools such as wrenches, screwdrivers, pliers, and the like, repair personnel may often rest such tools upon convenient surfaces found in the hoist mechanism. However, for larger tools, a problem in resting tools upon such surfaces often arises. The difficulty in managing such larger tools is more acute in connection with tools operative from compressed air. As is common in commercial and industrial repair facilities, many tools are operative from a remote compressor and coupled thereto by a high pressure air hose. The hose is usually left coupled to the air powered tool even during nonuse and presents a constant problem due to the loose hose extending from the tool to the floor area beneath the hoist.

One of the most commonly used air powered tools is known as an air ratchet which generally comprises an elongated often cylindrical housing having an air pressure hose coupling at one end and a ratchet drive at the other end. The drive terminates in a conventional square drive which permits a variety of sockets and the like to be interchangeably coupled to the air ratchet for use. A handle portion of the air ratchet supports a trigger mechanism used to activate the air powered portion of the ratchet. While the constructions and configurations of such air ratchets vary somewhat between manufacturers, they all share the characteristic of substantial weight and substantial difficulty in finding a convenient resting place during temporary periods of nonuse. Because the typical use of such air ratchets in repair and maintenance operation involves frequent intervals of brief use interleaved with frequent intervals of temporary nonuse, mechanics and other repair and maintenance personnel frequently find themselves constantly bending over to retrieve an air ratchet from the floor area or slowed in the work activities by the need to move about beneath the vehicle to retrieve the air ratchet from the previous resting place.

Because the inconvenience in retrieving tools encountered by mechanics and other repair and maintenance personnel is directly reflected in their efficiency and the costs of vehicle repair and maintenance, a need exists in the art for a convenient easy to use means for temporarily holding such air ratchets when not in use.

SUMMARY OF THE INVENTION

Accordingly, it is a general object of the present invention to provide an improved holder for air ratchet tools. It is a more particular object of the present invention to provide an improved holder for air ratchet tools which may be readily moved about beneath the to-be-repaired vehicle and maintained in close proximity to the mechanic or repair personnel. It is a still more particular object of the present invention to provide an improved holder for air ratchet tools which permits the attachment and removal of the air ratchet tool from the holder by a single hand.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
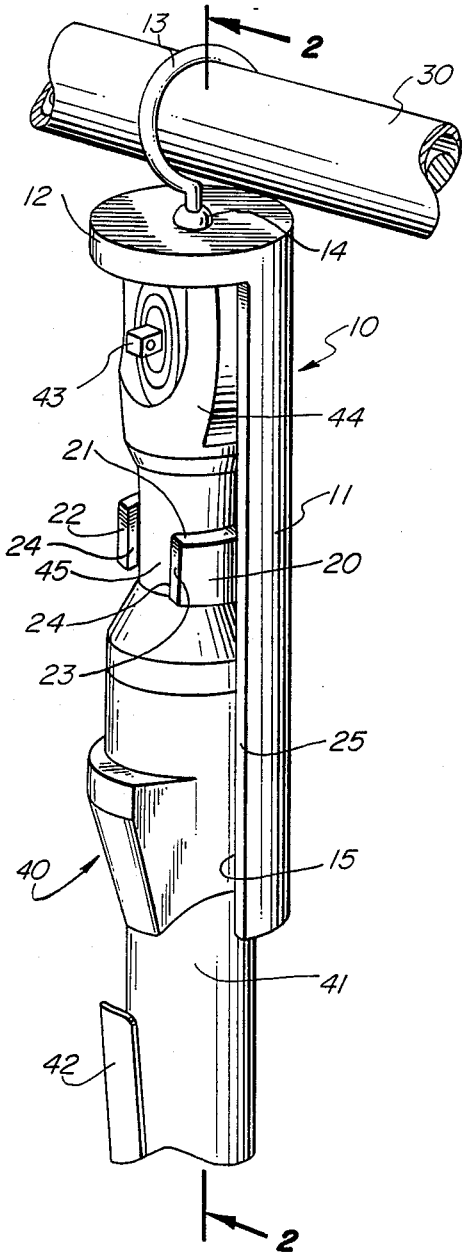
FIG. 1 is a perspective view of the present invention air ratchet holder supporting a typical air ratchet.

FIG. 1 sets forth a perspective view of the present invention air ratchet holder generally referenced by numeral 10 and supporting a typical air ratchet 40 in accordance with the present invention. Holder 10 includes a generally semicylindrical cradle portion 11 defining a cradle interior 15 and a pair of generally straight edges 25 and 26 (the latter seen in FIG. 3). Holder 10 further defines a circular end cap 12. A hook 13 is secured to end cap 12 by a hook fastener 14. A clasp member 20 comprises a generally cylindrical band having a pair of clasp ends 22 and 23 spaced apart and defining a gap 24. Clasp 20 further defines a clasp interior 21. In the position shown, hook 13 encircles a tierod 30 which is representative of any number of convenient portions of a vehicle upon which holder 10 may be secured by hook 13.

Air ratchet 40 is representative of the various types of air ratchet tools and comprises a generally elongated body 41 supporting an air trigger lever 42 at one end and a drive head 44 at the other end. Drive head 44 in turn supports a rotatable drive 43. Air ratchet 40 further defines a reduced diameter neck portion 45 between body portion 41 and drive head 44. The general configuration of air ratchet 40 is typical of air ratchet tools and should be understood to include the usual and customary mechanisms for coupling air ratchet 40 to a source of compressed air power (not shown) and for operating in response to such compressed air power to provide torque to drive 43. In the position shown in FIG. 1, air ratchet 40 is secured within holder 10 and maintained therein by the grasp of clasp member 20 upon neck 45. Neck 45 is received and secured within clasp interior 21. In accordance with an important aspect of the present invention, clasp member 20 has been carefully configured to permit neck 45 of air ratchet 40 to be forced through gap 24 between clasp ends 22 and 23 in order to insert air ratchet 40 into cradle interior 15. Conversely, clasp member 20 permits air ratchet 40 to be withdrawn from holder 10 by simply grasping body 41 and pulling ratchet 40 outwardly forcing neck 45 through gap 24.

It should be noted that the shape of clasp member 20 is carefully selected to provide the simultaneous qualities of a secure grip upon neck 45 of air ratchet 40 and the easy removal of air ratchet 40 from holder 10. It will be apparent to those skilled in the art, that in accordance with an important aspect of the present invention hook 13 may be readily secured to any number of undercarriage portions and underbody portions of the vehicle during the repair and maintenance process. It should be understood, therefore, that while FIG. 1 shows hook 13 secured to tierod 30, it may readily be secured to any number of portions of the vehicle under repair or maintenance. It should be further understood that while ratchet 40 is typical of air ratchets of the type to which the present invention pertains, holder 10 may accommodate a variety of air ratchet structures and configurations.

Figure 2:
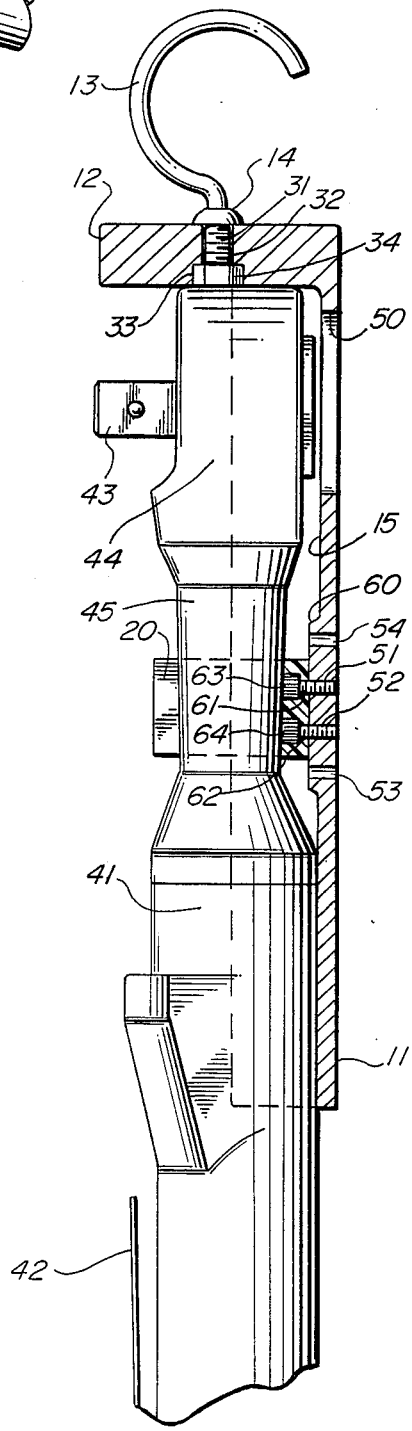
FIG. 2 is a section view of the present invention air ratchet holder supporting an air ratchet taken along section lines 2—2 in FIG. 1.

FIG. 2 sets forth a section view of the present invention air ratchet holder taken along section lines 2—2 in FIG. 1. In addition, it should be noted that FIG. 2 sets forth air ratchet 40 secured within holder 10 in the manner shown in FIG. 1. Air ratchet holder 10 defines a cradle portion 11 having a cradle interior 15 and an end cap 12. As mentioned above, end cap 12 is a generally circular member joined to cradle portion 11. Cradle portion 11 further defines a generally rectangular aperture 50 and a plurality of apertures 51 through 54. As is better seen in FIG. 3, apertures 51 through 54 are arranged along a common center line. Cradle interior 15 further defines a raised boss 60 which extends inwardly from cradle portion 11. Clasp 20, which as mentioned above comprises a generally C-shaped member, defines a pair of apertures 61 and 62. In accordance with an important aspect of the present invention, the spacing between apertures 61 and 62 corresponds to the spacing between adjacent ones of apertures 51 through 54. As a result, clasp 20 may be positioned in one of three alternate positions within cradle portion 11 by aligning apertures 61 and 62 with the selected ones of apertures 51 through 54. For example, in the position shown, apertures 61 and 62 are aligned with apertures 51 and 52 and a pair of cap screws 63 and 64 are threadably received within apertures 51 and 52 respectively to secure clasp 20 in the center position shown in FIG. 2. Alternatively, however, clasp 20 may be raised by aligning apertures 61 and 62 with apertures 54 and 51 respectively. Conversely, clasp 20 may be lowered by aligning apertures 61 and 62 with apertures 52 and 53 respectively. In either event, cap screws 63 and 64 function to secure clasp 20 within cradle interior 15.

End cap 12 defines a center aperture 32 and a recess 33. Correspondingly hook fastener 14 further includes a threaded portion 31 and a nut 34 received thereon. Nut 34 is tightened upon thread 31 and is received within recess 33 to secure hook 13 to end cap 12.

In the position shown, air ratchet 40 is received within cradle interior 11 such that drive 43 extends outwardly from cradle 11 and such that neck 45 is received and secured within clasp 20. Alternatively, however, air ratchet 40 may be rotated from the position shown in FIG. 2 such that drive 43 extends through aperture 50 in cradle portion 11. That is to say, air ratchet 40 may be rotated one hundred and eighty degrees from the position shown in FIG. 2. When air ratchet 40 is alternately positioned, aperture 50 provides a clearance for receiving drive 43. But for the use of aperture 50, holder 10 could not properly receive air ratchet 40 within cradle 11 and clasp 20 could not properly grasp neck 45 of air ratchet 40.

Figure 3:
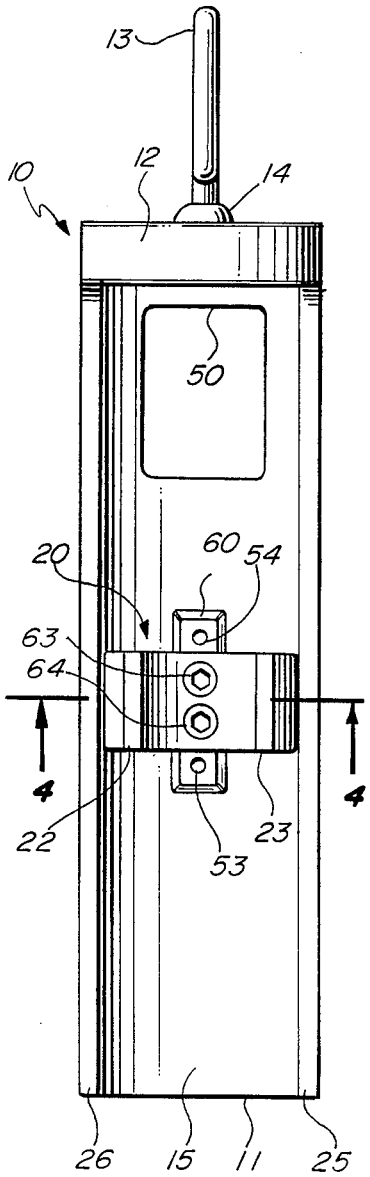
FIG. 3 is a front view of an air ratchet holder constructed in accordance with the present invention.

FIG. 3 sets forth a front view of the present invention air ratchet holder 10 with ratchet 40 removed therefrom. Holder 10 defines cradle portion 11 which in turn defines cradle interior 15. Edges 25 and 26 extend alongside cradle interior 15 and terminate at end cap 12. As set forth above, hook 13 is secured to end cap 12 by fastener 14. A retangular aperture 50 extends through the upper portion of cradle 11. An elongated generally rectangular raised boss 60 defines a plurality of apertures 51 through 54 (better seen in FIG. 2). Clasp 20 is secured to boss 60 within cradle interior 15 by a pair of cap screws 63 and 64. It will be apparent from examination of FIG. 3 that clasp 20 is readily movable upon boss 60 to the abovedescribed alternate positions. It should also be noted that clasp 20 defines a pair of clasp ends 22 and 23 which are separated by a gap 24. As will be apparent from examination of FIG. 3, air ratchet 40 may be pressed into cradle interior 15 by forcing neck 45 (seen in FIG. 2) through gap 24 between clasp ends 22 and 23. In accordance with an important aspect of the present invention, clasp 20 is fabricated from a somewhat resilient material which permits ends 22 and 23 to flex outwardly to permit the neck of the air ratchet to pass through gap 24 and be received within clasp interior 21. While any number of resilient materials may be used to fabricate clasp 20, it has been found particularly advantageous to fabricate clasp 20 from Delrin material or the like.

Figure 4:
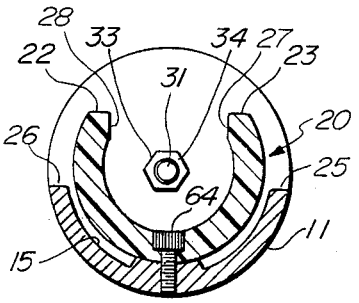
FIG. 4 is a section view of the present invention air ratchet holder taken along section lines 4—4 in FIG. 3.

FIG. 4 sets forth a section view of holder 10 taken along section lines 4—4 in FIG. 3. End cap 12 forms a circular member from which semicylindrical cradle 11 extends. Cradle portion 11 defines a pair of generally straight edges 25 and 26 on either side thereof. Cradle 11 further defines a cradle interior 15 having an upwardly extending generally rectangular raised boss 60. Boss 60 and cradle 11 define an aperture 52 as well as a plurality of other apertures (seen in FIG. 2). End cap 12 defines a recess 33 which receives a nut 34 upon a threaded portion 31 of fastener 14 (the latter seen in FIG. 2). Clasp 20 defines a generally C-shaped cross section member having a clasp interior 21, an aperture 62 and a pair of clasp ends 21 and 22. A cap screw 64 is received within apertures 62 and 52 to secure clasp 20 to boss 60 within cradle interior 15. A pair of flat surfaces 27 and 28 extend inwardly from clasp ends 21 and 22 respectively. It has been found that the positions of flat surfaces 27 and 28 greatly facilitate the passage of the air ratchet neck portion to and from clasp interior 21. Accordingly, the spacing between flat surfaces 27 and 28 which corresponds to gap 24 is carefully selected to accommodate the neck portions of the air ratchets used in combination with holder 10. It will be apparent from examination of FIG. 4 that alternative sized clasp members may be substituted for clasp 20 to accommodate an even greater range of air ratchet size and configurations.

Figure 5:
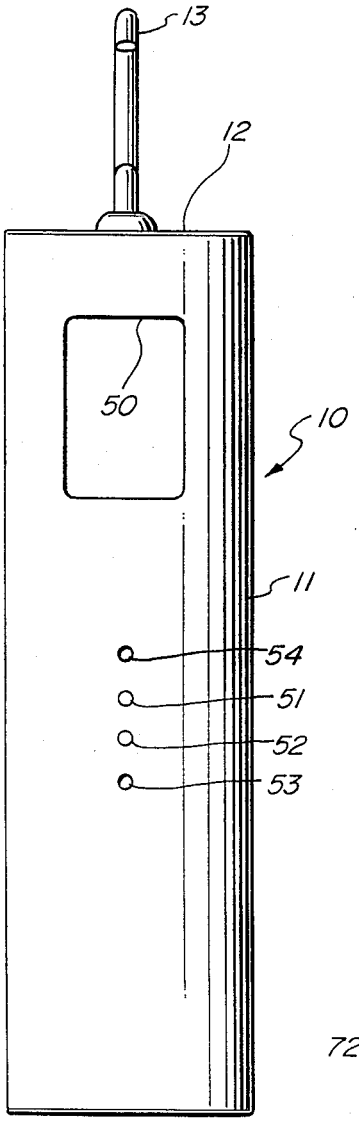
FIG. 5 is a rear view of an air ratchet holder constructed in accordance with the present invention.

FIG. 5 sets forth a rear view of air ratchet holder 10. Holder 10 includes a semicylindrical cradle portion 11 defining a rectangular aperture 50 therethrough. In addition, cradle portion 11 defines a plurality of threaded apertures 51 through 54 arranged along a common center line. Cradle 11, as mentioned above, terminates at one end in a circular end cap 12 which in turn supports a hook 13 and fastener 14.

Figure 6:
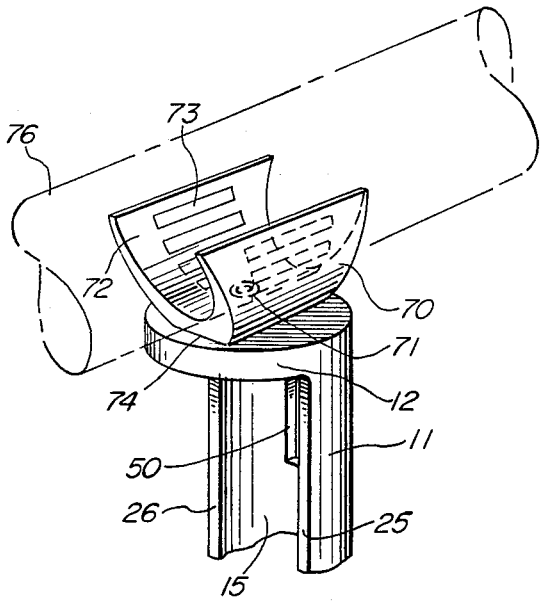
FIG. 6 is a partial perspective view of an alternate embodiment of the present invention air ratchet holder.

FIG. 6 sets forth an alternate embodiment of the present invention holder in which hook 13 and fastener 14 are replaced by a magnetic clasp 70. Magnetic clasp 70 defines a generally C-shaped member having a cylindrical interior portion 72 and a flat surface 74. Magnetic clasp 70 further defines an aperture 75 which receives a fastener 71. In similar fashion to the securing of hook 13 set forth in the embodiment above, fastener 71 extends through aperture 75 and through aperture 32 (seen in FIG. 2) to secure surface 74 of magnetic clasp 70 to end cap 12 of cradle 11. Clasp 70 further supports a plurality of elongated magnets 73 embedded within interior 72. Clasp 70 is specifically adapted to magnetically attach to a cylindrical metal portion of the vehicle being serviced such as a tierod 76. It will be apparent that the remainder of the alternate embodiment of holder 10 set forth in FIG. 6 may be identical to that set forth in the foregoing embodiments. Specifically, clasp 20 may be supported within cradle interior 15 of cradle 11 in the identical manner set forth above for the embodiment shown in the preceding figures.

Figure 7:
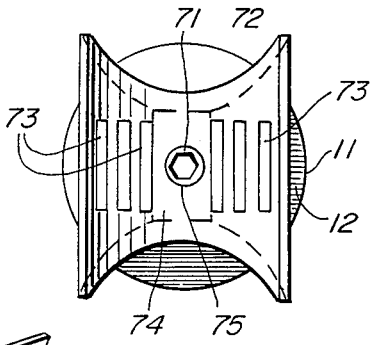
FIG. 7 is a top view of the alternate embodiment of the present invention air ratchet holder of FIG. 6.

FIG. 7 sets forth a top view of magnetic clasp 70 showing magnets 73 embedded within interior 72. In addition, FIG. 7 more clearly shows the attachment provided by fastener 71 which secures surface 74 of magnetic clasp 70 to end cap 12 of cradle 11.

Figure 8:
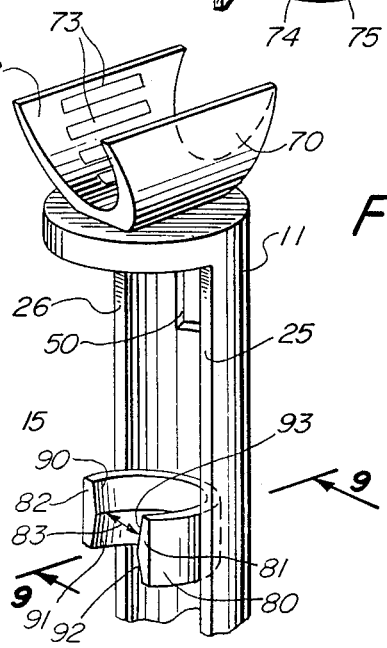
FIG. 8 is a partial perspective view of the alternate embodiment of the present invention air ratchet holder shown in FIGS. 6 and 7.
Figure 9:
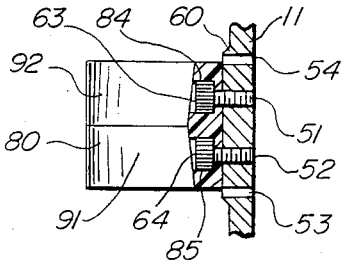
FIG. 9 is a partial section view of the alternate embodiment of the present invention air ratchet holder shown in FIGS. 6 through 8 taken along section lines 9—9 in FIG. 8.

FIG. 8 sets forth a still further alternate embodiment of the present invention air ratchet holder in which cradle 11 having a structure identical to that set forth above in the foregoing embodiments, defines an end cap 12 and a pair of elongated edges 25 and 26. In accordance with the embodiments set forth in FIGS. 6 and 7 above, a magnetic clasp 70 defines a generally C-shaped member having an interior 72 supporting a plurality of embedded elongated magnets 73. In addition, cradle 11 defines an aperture 50 as set forth above. The embodiment shown in FIG. 8 differs from the foregoing embodiments in that a clasp 80 is substituted for clasp 20 in the foregoing embodiments. Clasp 80 defines a generally C-shaped structure having expanded ends 81 and 82 separated by a gap 83. With simultaneous reference to FIG. 9, it will be apparent that clasp 80 is secured within cradle interior 15 in the same manner as clasp 20 is secured in the above-described embodiments. Accordingly, clasp 80 defines a pair of apertures 84 and 85 which receive cap screws 63 and 64 respectively to secure clasp 80 to boss 60 of cradle interior 15.

Clasp 80 further differs from clasp 20 in its inwardly tapered sides 91, 92, 93 and 94 and ends 81 and 82. This inward taper of sides 91 through 94 and ends 81 and 82 better accommodates air ratchets having inwardly tapered neck portions but otherwise functions in essentially the same manner as clasp 20 to secure the neck portion of the air ratchet within cradle interior 15.

It will be apparent to those skilled in the art that while the alternate embodiment shown in FIG. 8 shows the combination of clasp 80 and magnetic clasp 70 in attachment to cradle portion 11, clasp 80 may be similarly substituted in the embodiment shown in FIGS. 1 through 5 with equal ease.

What has been shown is a convenient easy to use air ratchet holder which is readily attachable to the undercarriage of a vehicle supported upon a raised hoist or the like. The device shown permits a variety of air ratchets to be quickly and easily secured within or removed from the ratchet holder using a single hand.

While particular embodiments of the invention have been shown and described, it will be obvious to those skilled in the art that changes and modifications may be made without departing form the invention in its broader aspects. Therefore the aim in the appended claims is to cover all such changes and modifications as fall within the true spirit and scope of the invention.

That which is claimed is:

1. For use in receiving and holding an air ratchet having a head, a shaft and a handle, a holder comprising:

a concave body having a cradle portion defining a cradle interior and an end cap;

a hook secured to and extending from said end cap; and clasp means, supported within said cradle interior, for grasping said shaft of said air ratchet and supporting said air ratchet solely by said shaft in an attachment in which said ratchet may be withdrawn from said holder by movement away from said concave body.

2. A holder as set forth in claim 1 wherein said air ratchet defines a neck portion and wherein said clasp means includes a generally C-shaped member having a center base secured to said cradle interior and a pair of curved outwardly extending end portions, said C-shaped member being snap fitted to said neck of said air ratchet.

3. A holder as set forth in claim 2 wherein said concave body defines a generally semicylindrical shape and wherein said end cap defines a generally circular shape.

4. A holder as set forth in claim 3 wherein said C-shaped member is formed of a resilient material.

5. A holder as set forth in claim 4 wherein said outwardly extending end portions of said C-shaped member each define an end surface extending transversely across said end portions and an interior surface extending inwardly from said end surfaces forming a gap therebetween.

6. A holder as set forth in claim 5 wherein said cradle interior defines a raised boss supporting said C-shaped member.

7. A holder as set forth in claim 6 wherein said concave body defines an aperture extending downwardly from said end cap.

8. A holder as set forth in claim 7 wherein said raised boss defines a plurality of threaded apertures spaced along a common line and wherein said C-shaped member defines a pair of apertures alignable with selected ones of said plurality of apertures and wherein said holder includes a pair of fasteners received within said pairs of apertures and a selected two of said plurality of apertures to secure said C-shaped member within said cradle interior.

9. For use in receiving and holding an air ratchet having a head, a shaft and a handle, beneath a vehicle having metal elements, a ratchet holder comprising:

an elongated semicylindrical cradle having an open concave cradle interior a circular end cap and an open end;

spring operated clasp means within said concave interior for grasping the handle of said air ratchet solely by the shaft thereof in a snap-fit attachment which permits the ratchet to be withdrawn from said cradle through the open side thereof; and attachment means secured to said end cap and having means for attachment to said metal elements of said vehicle.

10. A ratchet holder as set forth in claim 9 wherein said attachment means include a hook configured to partially encircle a selected one of said metal elements of said vehicle.

11. A ratchet holder as set forth in claim 9 wherein said attachment means include a curved magnetic clasp configured to magnetically attach to a selected one of said metal elements.

12. A ratchet holder as set forth in claim 11 wherein said curved magnetic clasp includes a plurality of discrete magnets embedded within said magnetic clasp.

13. A ratchet holder as set forth in claim 12 wherein said clasp means include a curved resilient clamp having a base portion secured to said cradle interior and a pair of curved arms extending in circular arcs therefrom and terminating in end portions spaced apart to form a gap therebetween.

14. A ratchet holder as set forth in claim 13 wherein said curved arms increase in width from said base to said end portions.

15. A ratchet holder as set forth in claim 9 wherein said clasp means include a curved resilient clamp having a base portion secured to said cradle interior and a pair of curved arms extending in circular arcs therefrom and terminating in end portions spaced apart to form a gap therebetween.

16. A ratchet holder as set forth in claim 15 wherein said curved arms increase in width from said base to said end portions.

* * * * *